United States Patent [19]

Mc Geady et al.

[11] 4,072,155

[45] Feb. 7, 1978

[54] STIFFENING OF TOBACCO WITH DIALDEHYDE

[75] Inventors: JaYong C. Mc Geady, Brown Summit; Claude I. Lewis, Greensboro, both of N.C.

[73] Assignee: Lorillard, New York, N.Y.

[21] Appl. No.: 705,522

[22] Filed: July 15, 1976

[51] Int. Cl.[2] ..... A24B 3/18

[52] U.S. Cl. ..... 131/140 P; 131/17 R

[58] Field of Search ..... 131/2, 17 R, 140 C, 131/140 R, 140 P, 15, 142; 106/169

[56] References Cited

U.S. PATENT DOCUMENTS

| | | | |
|---|---|---|---|
| 937,801 | 10/1909 | Hastings | 131/140 R |
| 2,734,513 | 2/1956 | Hungerford et al. | 131/140 R |
| 2,739,600 | 3/1956 | Staib | 131/142 |
| 2,887,414 | 5/1959 | Rosenberg et al. | 131/17 R |
| 2,988,455 | 6/1961 | Rosenberg et al. | 106/169 |
| 3,106,212 | 10/1963 | Halter et al. | 131/17 R |
| 3,126,012 | 3/1964 | Jarboe et al. | 131/17 R |
| 3,421,519 | 1/1969 | Moshy et al. | 131/17 R |
| 3,542,035 | 11/1970 | Dierichs | 131/140 C X |
| 3,948,275 | 4/1976 | Sanford | 131/17 R |

OTHER PUBLICATIONS

"Commercial Development of Glyoxal" by Bohmfalk, Jr. et al., found in *Industrial and Engineering Chemistry*, vol. 43, No. 4, pp. 786–794.

*Primary Examiner*—Stephen C. Pellegrino
*Assistant Examiner*—V. Millin
*Attorney, Agent, or Firm*—Brumbaugh, Graves, Donohue & Raymond

[57] ABSTRACT

The stiffness of tobacco is increased by treating tobacco with a dialdehyde. The treatment is carried out in the presence of a suitable catalyst. The reaction of the dialdehyde with tobacco may be at room temperature, but is accelerated by heating to 120°–130° C.

2 Claims, 1 Drawing Figure

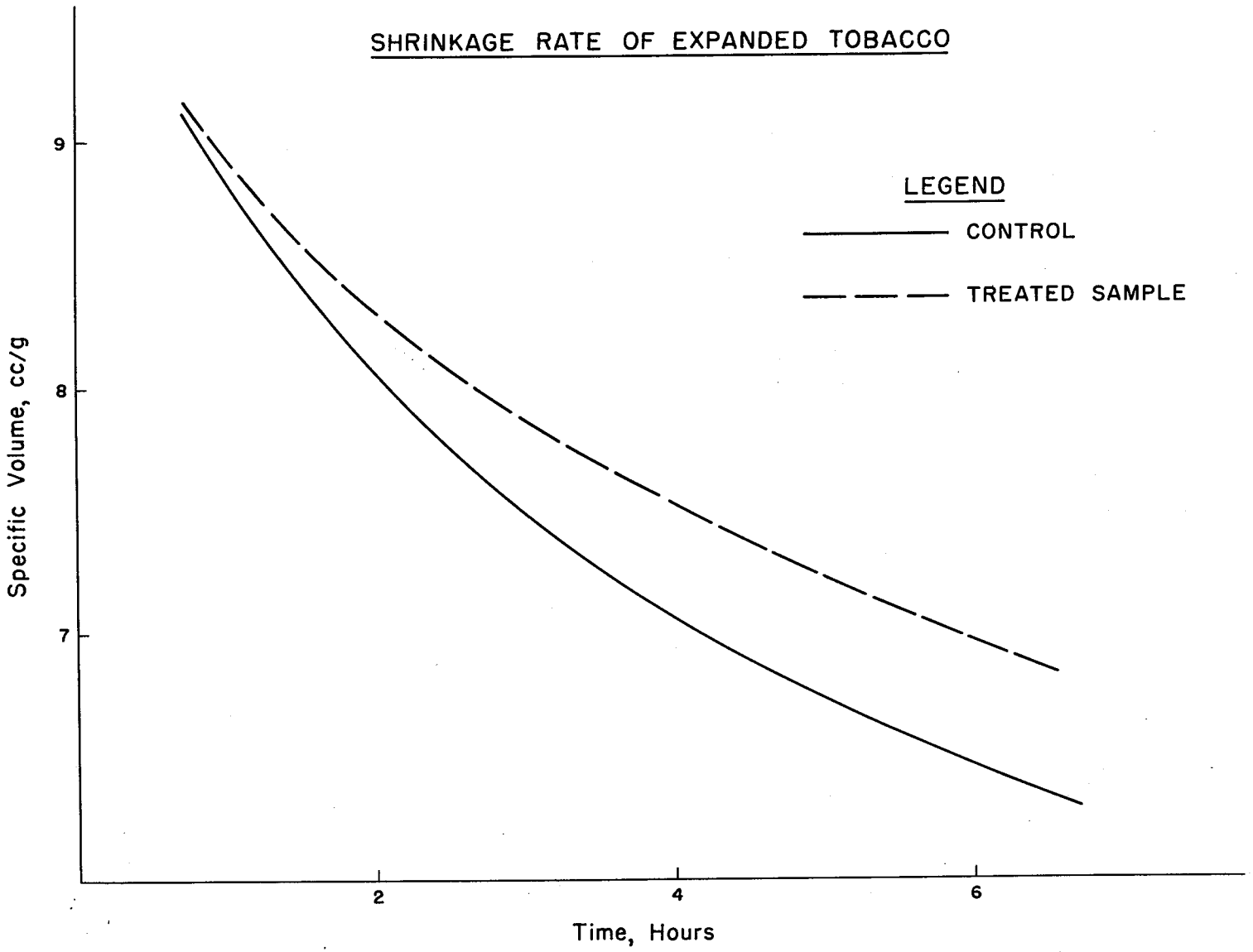
SHRINKAGE RATE OF EXPANDED TOBACCO
LEGEND
CONTROL
TREATED SAMPLE
Specific Volume, cc/g
9
8
7
Time, Hours
2
4
6

STIFFENING OF TOBACCO WITH DIALDEHYDE

This invention relates to a method of treating tobacco to improve its stiffness.

BACKGROUND OF THE INVENTION

It has been the custom in the tobacco industry for some period of time to characterize the filling power of tobacco by means of procedures which determine the volume of tobacco occupied by a specific weight thereof under standard packing conditions. The greater volume of the tobacco, the less is the amount of tobacco required to fill a cigarette. Obviously, techniques for improving the filling capacity of the tobacco are desirable.

Within the past 10 years the tobacco industry has seen the commercial development of processes for expanding tobacco. These procedures generally involve rapid vaporization, solvent treatment, or both, as described, inter alia, in U.S. Pat. Nos. 2,344,106, 2,653,093, 2,739,599, 3,141,871 and 3,452,451, and Canadian Pat. No. 680,461. Some of the procedures, for example, involve rapid vaporization of liquids such as water or various organic liquids present in the interstices of the cellular structure of the tobacco. Rapid vaporization causes the cellular structure to expand and increase the filling power of the tobacco. Puffing may also be obtained by subjecting tobacco to high pressure gas or vapor and rapidly releasing that pressure.

THE INVENTION

The present invention provides a novel process for improving the filling capacity of tobacco. This is accomplished by subjecting the tobacco to reaction with a dialdehyde under suitable conditions which causes the tobacco to stiffen and to have increased filling capacity.

The process of the present invention has unexpected advantages over the methods now in commercial use. It has been found that tobacco subjected to conventional filling processes based on rapid vaporization sometimes shrinks during smoking. It is believed that this may be due to exposure to moisture generated by the combustion of the tobacco. Surprisingly, tobaccos treated by the present invention show improved stability of firmness on exposure to moisture.

This advantage of the present invention may be realized from treatment of ordinary or shredded leaf. However, it is equally realized when the stiffening process of the present invention is applied to puffed tobacco. The improved stiffness tends to make conventional puffed tobacco less likely to lose filling capacity upon smoking.

In accordance with this invention, a process is provided in which the tobacco is treated with a dialdehyde of the formula

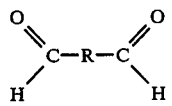

wherein R is a straight or branched chain group of the formula $(CH_2)_n$, $n$ being from 0 to 6, or such an alkylene group substituted by small, physiologically innocuous radicals such as OH, phenyl, etc. The primary limitation on the alkylene substituent is that it not be bulky and not leave undesirable taste effects. Based on tests to date, glyoxal (i.e., $(CH_2)_n$ wherein $n = 0$) is preferred. The aldehyde reacts with the tobacco, causing it to stiffen.

The stiffness thus imparted provides dimensional stability to the tobacco.

In the practice of the present invention, it is presently believed that the stiffening reactions depend upon the presence of the free aldehyde moiety. Aldehydes are known to condense in the pure form to dimers and trimers. Hence in carrying out the process which we have discovered, a solvent should be used which will permit the aldehydes to exist in the non-condensed form.

It is preferred to employ the aldehyde in the form of an aqueous solution generally at a concentration of as little as 5%. Higher concentration may be used up to the solubility limit, for instance, as high as 60%. Aqueous solutions of 25–50% are preferred. Use of the dialdehyde in the form of an aqueous solution provides a convenient and commercially practical form of applying the dialdehyde efficiently and uniformly to the tobacco.

In general, the present invention may be applied to any of the known whole tobaccos such as Turkish tobacco, burley tobacco, flue-cured tobacco and the like. It is preferable to shred the tobacco before treatment with dialdehyde since the dialdehyde can penetrate into the shredded tobacco more easily. By "whole" tobacco it will be understood that reference is made to tobacco leaf or cut or shredded tobaccos made therefrom suitable for use in smoking products, as distinguished from reconstituted leaf formed from fines and waste tobaccos not otherwise suitable for direct use in a finished product.

While the present invention is not limited to any particular theory, we believe that an explanation for the results we obtain lies in reactions occurring between the aldehyde moieties of the dialdehyde compound and either amino acid or cellulose present in the tobacco. Both of these reactions are influenced by particular reaction conditions.

It has been found, for example, that with acidic materials such as monobasic ammonium phosphate, the reaction appears to be between the aldehyde and cellulose. Strong mineral acids such as sulphuric acid, phosphoric acid, and hydrochloric acid are also suitable catalysts to promote the aldehyde-cellulose reaction. In the case of these acidic substances, we believe that the formation of an acetal may be a factor in the reaction and, therefore, substances generally recognized as promoting acetal formation might be substituted for monobasic ammonium phosphate. Other recognized catalysts for use in the formation of acetals are para-toluenesulfonic acid, as well as certain salts.

Certain basic substances will promote reaction between the aldehyde and the amino moiety. Ammonium carbonate and ammonium bicarbonate have been found particularly suitable as basic catalysts. When using such substances, we believe that the aldehyde-amino acid reactions are generally promoted under conditions in which the aldehydes will form a Schiff base with the aldehyde. Thus, ammonia and ammonium salts are indicated as suitable catalysts, particularly ammonia salts such as ammonium acetate, which will liberate a volatile anion to promote complete formation of the Schiff base.

Reaction conditions for completing the aldehyde stiffening reactions are not critical. If sufficient time is allowed the reaction will proceed adequately at room temperature (i.e., 25° C). For commercial applications, it is desirable, however, to effect the reaction as rapidly as practicable. Mild heating is suitable for this purpose. For example, the stiffening reaction may be carried out while the temperature is maintained between 120° and 130° C. for a period of 6–12 minutes. More severe conditions, i.e., higher temperatures or longer times, should be avoided since such conditions tend to produce overly dry tobacco products not suitable for manufacturing cigarettes. If the reaction is carried out at lower temperatures, particularly below the boiling point of water (about 100° C.), appropriate provisions will, of course, have to be made to dry the tobacco after completion of the reaction. Carrying out the stiffening reaction above the boiling point of water obviously permits the stiffened tobacco product to dry while the stiffening reaction goes forward.

THE PRIOR ART

Prior to our discovery that dialdehydes can be used to improve the stiffness of tobacco, we are aware of little prior art suggesting applications for aldehydes in the tobacco industry. Staib U.S. Pat. No. 2,739,600 discloses a process for manufacture of reconstituted tobacco sheets. In the manufacture of reconstituted tobacco, finely divided tobacco such as tobacco dust recovered during the processing is mixed with a film from a gum or adhesive. The slurry is formed into a sheet or film and dried. Staib suggests that in the manufacture of reconstituted tobacco sheets as just described the stability of the slurry of tobacco and adhesive may be improved by treating the finely divided tobacco with an aqueous solution of an aldehyde such as glyoxal and thereafter heating the tobacco prior to mixing it with the adhesive. In other processes relating to the manufacture of reconstituted tobacco sheets, several patents have suggested directly adding a dialdehyde such as glyoxal to the slurry of film from adhesives and finely divided tobacco particles (see Hungerford et al. U.S. Pat. No. 2,734,513, Rosenburg et al. U.S. Pat. No. 2,887,414, Halter et al. U.S. Pat. No. 3,106,212 and Moshy et al. U.S. Pat. No. 3,421,519).

The Heddles U.S. Pat. No. 937,801 describes a process which maintains tobacco leaf in a soft pliable form involving treating tobacco leaves with a solution containing alcohol and formaldehyde.

EXAMPLES.

The present invention may be further understood by the following examples of the practice thereof:

EXAMPLE 1

An aqueous glyoxal solution (125 ml of 40% solution) was placed in an aerosol spraying apparatus and 15g of monobasic ammonium phosphate was added. The mixture was stirred until the ammonium phosphate was dissolved. The expanded tobacco (500g) was sprayed with the solution and remained at room temperature for 72 hours. The resultant product was stiffened and its filling capacity increased. The specific volume (cc/gm.) was determined by the method described in U.S. Pat. No. 3,788,125 issued Jan. 29, 1974.

| | Specific Volume (cc/gm.) |
|---|---|
| Control | 8.81 |
| Treated | 9.25 |

EXAMPLE 2

An aqueous solution of glyoxal (14 ml of 40% solution) was placed in an aerosol spraying apparatus and the solution was diluted to 100 ml with distilled water. Monobasic ammonium phosphate (15g) was added to the apparatus. The mixture was stirred until the ammonium phosphate was dissolved. The solution was sprayed on a shredded tobacco blend (500g). The treated tobacco was heated at 130° C. for 6 minutes. This treatment stiffened the blend and thus increased the filling capacity of the blend.

| | Specific Volume (cc/gm.) |
|---|---|
| Control | 4.09 |
| Treated | 4.12 |

EXAMPLE 3

A standardized aqueous glyoxal solution (63 ml of 40% solution) was placed in an aerosol spraying apparatus. The solution was adjusted to approximately pH 8.0 with a saturated ammonium carbonate solution. Shredded tobacco blend (500g) was sprayed with the solution. The treated tobacco was heated at 120° C. for 6 minutes. This treatment stiffened the tobacco blend and thus increased the filling capacity of the blend.

| | Specific Volume (cc/gm.) |
|---|---|
| Control | 4.82 |
| Treated | 5.11 |

EXAMPLE 4

An aqueous solution of glyoxal (63 ml of 40% solution) was adjusted to approximately pH 8.0 with a saturated solution of ammonium carbonate in an aerosol spraying apparatus. Shredded oriental tobacco (500g) was sprayed with the solution. The treated tobacco was treated at 120° C. for 6 minutes. This treatment stiffened the tobacco and thus increased the filling capacity of the tobacco.

| | Specific Volume (cc/gm.) |
|---|---|
| Control | 3.57 |
| Treated | 3.83 |

EXAMPLE 5

Shredded oriental tobaccl (500g) was sprayed with a saturated ammonium carbonate solution (50 ml) and then sprayed with an aqueous glutaraldehyde solution (100 ml of 25% solution). The treated tobacco was heated at 120° C. for 6 minutes. This treatment stiffened the tobacco and thus increased the filling capacity of the tobacco.

| | Specific Volume (cc/gm.) |
|---|---|
| Control | 3.46 |
| Treated | 4.01 |

EXAMPLE 6

A standardized aqueous solution of a practical glutaraldehyde (100 ml of 25% solution) was adjusted to approximately pH 8.0 with 10% (W/V) sodium bicarbonate solution. Shredded oriental tobacco (500g) was treated with the solution. The treated tobacco was heated at 120° C. for 6 minutes. This treatment stiffened the tobacco and thus increased the filling capacity of the tobacco.

| | Specific Volume (cc/gm.) |
|---|---|
| Control | 3.41 |
| Treated | 3.61 |

EXAMPLE 7

An aqueous glyoxal solution (315 ml of 40% solution) was placed in an aerosol spraying apparatus. The solution was adjusted to approximately pH 8.0 with saturated ammonium carbonate solution. The expanded tobacco (2500g) was sprayed with the solution and remained at room temperature for 72 hours. The control which is an expanded tobacco sample (2500g) treated with 315 ml of water and air dried for 72 hours at room temperature and the treated sample prepared above were placed in wet room (R.H. 80%, Temperature 100° F.). Samples were taken from the room in 45 minute intervals and the specific volume and oven moisture determined.

The specific volume ($V_{sp}$) in cc/gm of the treated sample, as a function of time (t) in hours is approximated by the relation $$V_{sp} = 9.2 - 0.38\,t$$

The control sample shrank more rapidly as represented by the equation $$V_{sp} = 9.1 - 0.43\,t$$

The results of this test are represented graphically in FIG. 1. As is evident from FIG. 1, tobaccos stiffened in accordance with the present invention have a significantly improved ability to retain their expansion when subjected to warm, humid conditions.

We claim:

1. A process for treating whole tobacco which comprises the steps of a. impregnating whole tobacco with an aqueous solution containing from 5 to 60% by weight of a dialdehyde of the formula

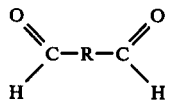

wherein R is an unsubstituted straight or branched chain alkylene radical of the formula $(CH_2)_n$, $n$ being from 0 to 6;

b. causing said dialdehyde to react with said tobacco in the presence of a catalyst effective to promote reactions with amino acids present in said tobacco, thereby to stiffen and increase the filling capacity of the tobacco; and c. thereafter drying said tobacco.

2. A process for treating whole tobacco which comprises the steps of a. impregnating whole tobacco with an aqueous solution containing 5 to 60% by weight of a dialdehyde of the formula

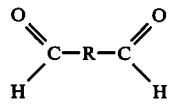

wherein R is an unsubstituted straight or branched chain alkylene radical of the formula $(CH_2)_n$, $n$ being from 0 to 6;

b. causing said dialdehyde to react with said tobacco in the presence of a catalyst selected from the group consisting of monobasic ammonium phosphate, sulfuric acid, phosphoric acid, hydrochloric acid, ammonium carbonate, ammonium bicarbonate and ammonia, thereby to stiffen and increase the filling capacity of the tobacco; and c. thereafter drying said tobacco.

* * * * *